US005966969A

United States Patent [19]

Mista

[11] Patent Number: 5,966,969

[45] Date of Patent: Oct. 19, 1999

[54] LIGHTWEIGHT, RIGID SEGMENT FOR CARRYING KNITTING ELEMENTS FOR A KNITTING MACHINE

[75] Inventor: Kresimir Mista, Heusenstamm, Germany

[73] Assignee: Karl Mayer Textilmachinenfabrik GmbH, Germany

[21] Appl. No.: 09/199,382

[22] Filed: Nov. 25, 1998

[30] Foreign Application Priority Data

Dec. 3, 1997 [DE] Germany ..... 197 53 590

[51] Int. Cl.[6] ..... D04B 23/00

[52] U.S. Cl. ..... 66/206; 66/203; 66/207; 66/208

[58] Field of Search ..... 66/203, 204, 207, 66/208, 87 R, 114, 206, 90, 116, 109

[56] References Cited

U.S. PATENT DOCUMENTS

| | | | |
|---|---|---|---|
| 2,682,163 | 6/1954 | Staff et al. | 66/208 |
| 2,786,344 | 3/1957 | Lambach et al. | 66/207 |
| 3,811,298 | 5/1974 | Kohl | 66/208 |
| 4,995,246 | 2/1991 | Reich | 66/207 |
| 5,878,599 | 3/1999 | Halassek | 66/208 |

FOREIGN PATENT DOCUMENTS

| | | | |
|---|---|---|---|
| 471657 | 9/1937 | United Kingdom | 66/206 |

*Primary Examiner*—John J. Calvert
*Assistant Examiner*—Larry D. Worrell, Jr.
*Attorney, Agent, or Firm*—Omri M. Behr, Esq.

[57] ABSTRACT

A segment carrying knitting elements for a warp knitting machine comprising a plurality of similar plates. Holes provided in said plates are penetrated by at least one hollow pin, which at its circumference is connected with the plates. This gives rise to low weight segments for attachment to the bars of a warp knitting machine.

14 Claims, 3 Drawing Sheets

LIGHTWEIGHT, RIGID SEGMENT FOR CARRYING KNITTING ELEMENTS FOR A KNITTING MACHINE

BACKGROUND OF THE INVENTION

1. Field of the Invention

The present invention relates to lightweight, rigid segment carrying knitting elements for a knitting machine.

2. Description of Related Art

Care must be taken to properly support knitting elements such as knock-over sinker plates, stitch comb plates, pile sinker plates, slider plates, thread comb plates, and other plate-like elements.

Conventionally the rear ends of these plates are embedded in a block of metal or synthetic material which, for its part, is attached to the bar. Herein it is already known to provide holes in the plates. The threading of a rod therethrough, which protrudes beyond the segment serves to brace the plates during the casting step (see DE PS 12 074 541). The disadvantage herein is the relatively large mass which limits the working speed of the warp knitting machine. Furthermore, cooling after the casting step leads to imprecision in the relative position of the plates.

It is also known (DE PS 813 741) to connect the forward ends of the plates of a segment by flanging a sheet metal strip of a light metal and to lay the rear ends into grooves formed in the bar and to press them against the bar by a tightening screw and cover plate. The thus formed segments are somewhat unstable before they are fixed to the bar and this makes attachment to the bar more difficult.

In the segment mentioned above and known from DE 72 26 832.7U, the pins have substantial mass and deform the plates on both sides.

Accordingly advances are accomplished over the prior art on a segment carrying knitting element for knitting machines having a number of similar plates which (a) are held and separated from each other by a predetermined distance by means of a connecting arrangement, and (b) are attachable to a bar by means of an attaching arrangement, wherein the connecting arrangement comprises at least one pin which penetrates holes in the plates and which at its circumference is connected with the plates.

SUMMARY OF THE INVENTION

In accordance with the illustrative embodiments demonstrating features and advantages of the present invention, there is provided a segment for carrying knitting elements and attaching them to a bar in a warp knitting machine. The segment includes a spaced plurality of plates separated by a predetermined distance, and each having a hole. Also included is a connecting arrangement having at least one hollow pin mounted through the holes in the plates. This pin has a circumference bearing upon the plates. The segment also includes an attachment arrangement for attaching the plates to the bar.

An object of the present invention is to provide a segment carrying knitting element of the known type, which has a lower mass and high rigidity. This problem is solved by the present invention in which the pins are hollow, that is, are provided as small tubes. A hollow pin has a much lower mass than a solid one and can nevertheless provide an adequately higher rigidity to the segment. Furthermore, it enables the warp knitting machine to operate at a higher working speed.

The connection between the pin and the holes is very tight since the entire circumference is available for gluing, form fitting adaptation, and the like. Even several pins only cause a very low and in extreme cases, even no weight increase. For this reason it is permissible, for the further improvement of the stability of the segment, to provide two or more pins. In particular, it is possible to provide the plate with so high a rigidity that the body vibration frequencies which occur at the stimulation of its own resonant frequency are outside the audible range. The entire production can take place without provision of heat. Thus, there is no danger that inconsistencies in plate spacing occur due to a cooling contraction. Since frequently two or more pins are utilized hereinbelow the plural is utilized. The principles can, of course, be applied to utilizing single pin.

It is particularly advantageous to provide pins out of the same material as the plates. This simplifies recycling since it is not necessary to separate different working materials which are combined with each other.

In particular these pins can be produced from light metals, for example aluminum, aluminum alloys and the like. This further saves weight.

It is advantageous to provide the pins with a lower wall thickness than the plates. In fact, it is possible to arrange that the weight of the hollow pins is less than the weight of the material removed from the plates by the creation of the holes therein. Additional pins for connection of the plates accordingly are also useable for reducing the weight.

Another advantage of hollow pins rests therein that they can be widened for connection with the plates. This leads to a very simple, but nevertheless exact method of manufacture.

Further it is advantageous if three or more hollow pins are utilized. To the extent that this exceeds the need for stabilization, it serves the purpose of reducing the weight.

A further preferred possibility lies therein, that the plates are glued to the pins. For this purpose, rather small amounts of glue are required in order to provide a secure connection. A further advantageous embodiment is given by the combination of widening the pins, as well as gluing, in particular with thin plates.

In a further embodiment of the invention the plates are provided with locking surfaces which, in combination with the mating surfaces on the bar, lead to a well defined end positioning. The segment is thus, in each case, installed in the same predetermined position.

For the rigid attachment of the segment to the bar there is a plurality of possibilities. It is advantageous to utilize the embodiments which are set forth in the appended claims.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
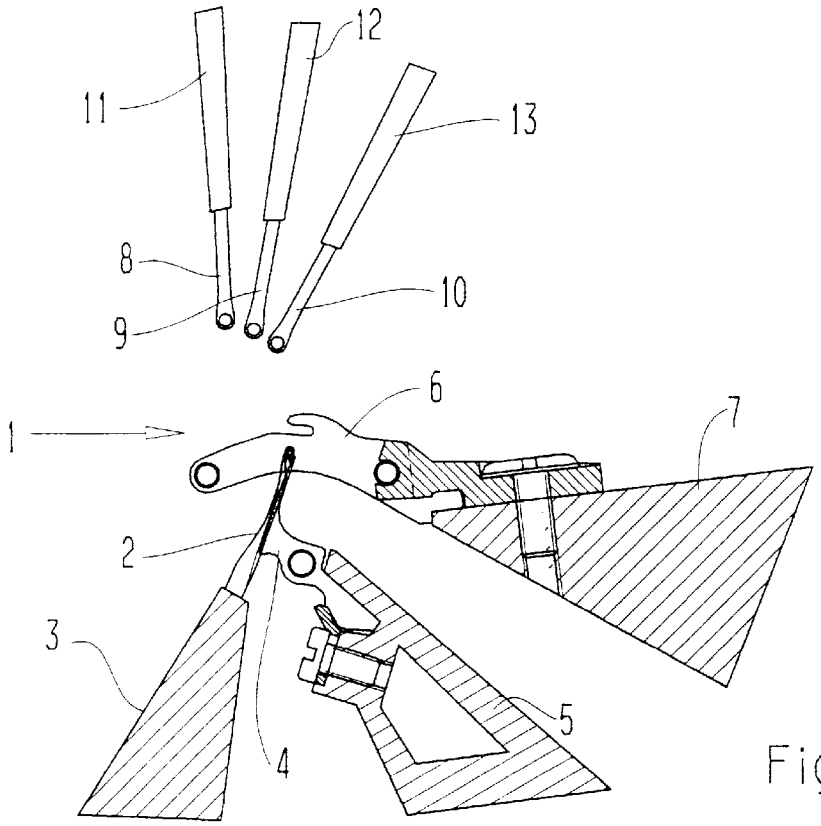
FIG. 1 is a cross-sectional, side elevational view of the working area of a warp knitting machine with a plurality of segments in accordance with the present invention.

FIG. 1 shows the working area 1 of a warp knitting machine. Needles 2 are attached to a needle bar 3. Slider plates 4 are held by a slider bar 5, and inclusion knock over plates 6 are carried by a knock over plate bar 7. Guides 8, 9 and 10 are attached to guide bars 11, 12 and 13, respectively. These knitting elements work with each other in the usual manner. They are combined to provide segments with a width of between 12.7 to 50.8 mm. These segments are secured to one of the bars. The plates 4 and 6 form the segments arranged in accordance with the present invention.

Figure 2:
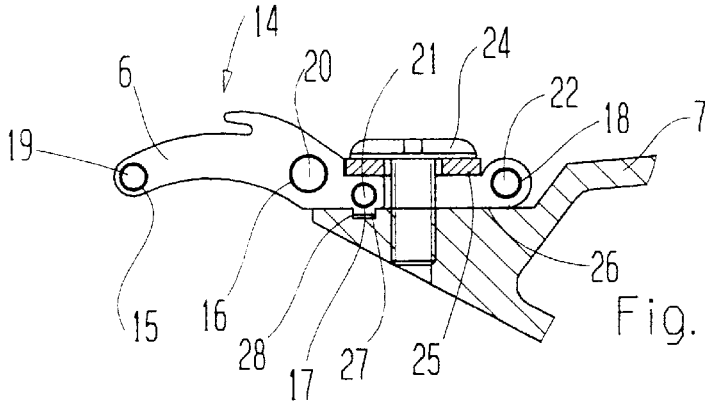
FIG. 2 is a side elevational, cross-sectional view of a segment with inclusion knock over plates.
Figure 3:
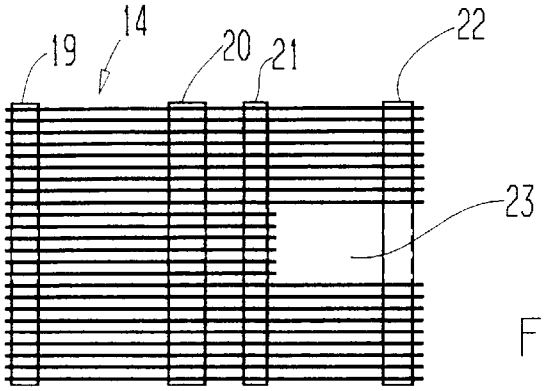
FIG. 3 is an overhead, plan view of the segment of FIG. 2.

FIGS. 2 and 3 show a number of plates 6 which are combined to form segment 14. For this purpose the plates possess holes 15, 16, 17 and 18 through which the hollow pins 19, 20, 21 as well as 22, respectively, are inserted and then widened by pressing through the pins a tool (mandrel) having a conical portion while the plates 6 are located in a holding means so that a rigid connection is achieved between the pins and the holes. The segment 14 has an extraordinary great stability even if it is produced from thin walled material and all of the portions (plates and hollow pins) are formed from the same material.

The inside ends of the middle plates 6 are truncated so that a clear region 23 results, through which an affixing screw 24 may be located. This screw can press, under interposition of a plate 25, on the upper side of the longer plates 6 so that the segment is pressed onto the receiving surface 26 of the bar 7. A rib 27 thus protrudes into groove 28 of bar 7 so that a defined, seated position for the segment is provided.

Figure 4:
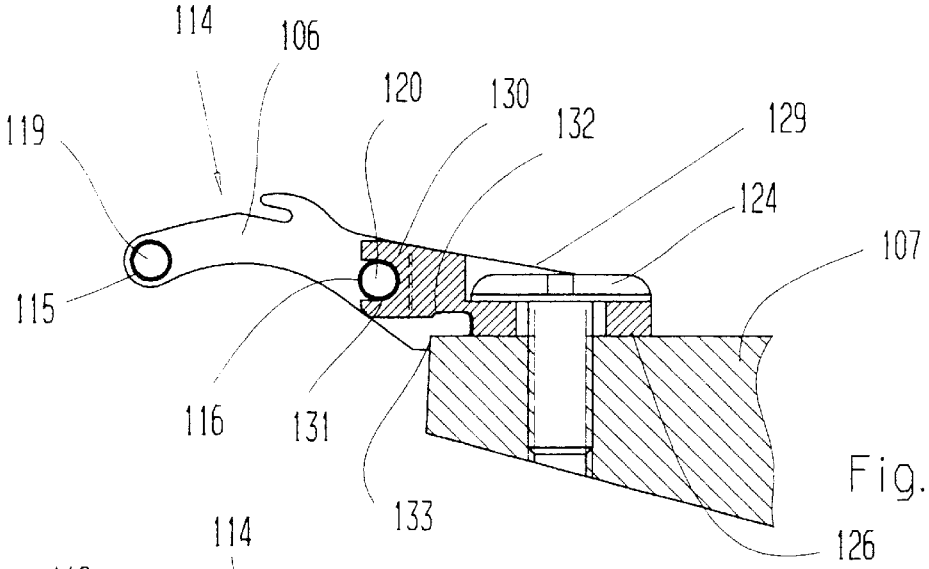
FIG. 4 is a second embodiment of a segment with inclusion knock over plates.
Figure 5:
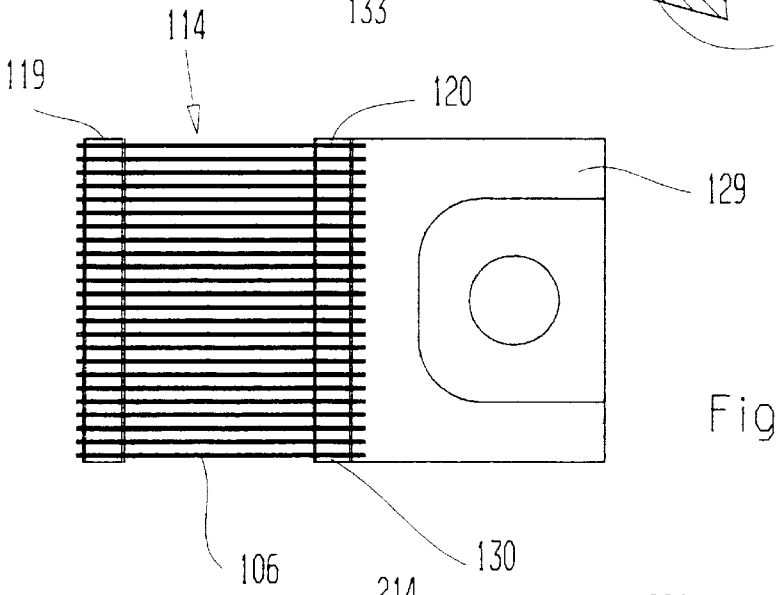
FIG. 5 is an overhead plan view of the segment of FIG. 4.

In the embodiment of FIGS. 4 and 5 the corresponding parts receive item numbers higher by 100 than the corresponding parts of FIGS. 2 and 3. For the affixation of the completed segment 114, there is here provided an intermediate piece 129 which may be pressed, by means of screw 124 onto the upper surface 126 of bar 107. The intermediate piece 129 is provided with grooves 130 to fit plates 106, as well as an opening 131 to receive pin 120. Intermediate piece 129 is first snapped over the hollow pin 120, being held vertically with opening 131 pointing down, and then turned 90°. Thus, by means of the angled locking surface 132 of the plate 106, the entire segment 114 is pulled to the right until the locking surface 133 contacts the bar 107.

Figure 6:
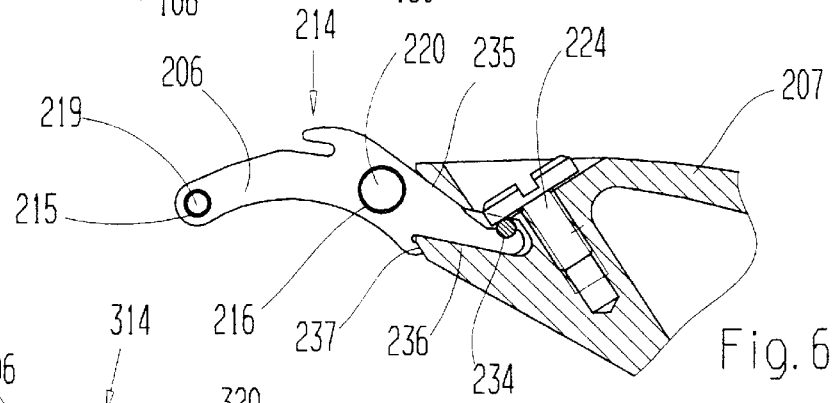
FIG. 6 is a third embodiment of a segment with inclusion knock over plates.

In the embodiment of FIG. 6 the appropriate segments have item numbers raised by 200 over the corresponding item numbers in FIGS. 2 and 3. Here there is provided a support element 234 at the end of plates 106 in the form of wire upon which the head of the clamping screw 224 will press. In this way wedge-shaped locking surfaces 235, 236 and 237 are pulled against the corresponding mating surfaces of bar 207 so that segment 214 takes up a secure, seated position. The exact fit can thus be obtained by form milling of the bar 207.

Figure 7:
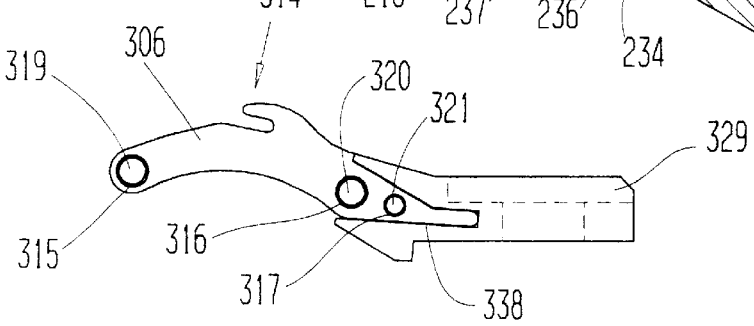
FIG. 7 is fourth embodiment of a segment with inclusion knock over plates.

In the embodiment of FIG. 7 the appropriate parts have item numbers raised by a further 100. Herein the rearward ends of the plates 306 are pressed into a take-up opening 338 of an intermediate piece 329 and there glued in with the intermediate piece. The end of piece 329 opposite opening 338 is bored to transversely receive a screw and thereby act as an attachment portion. Because of the stiffness of this segment a comparatively small amount of adhesive material is required.

Figure 8:
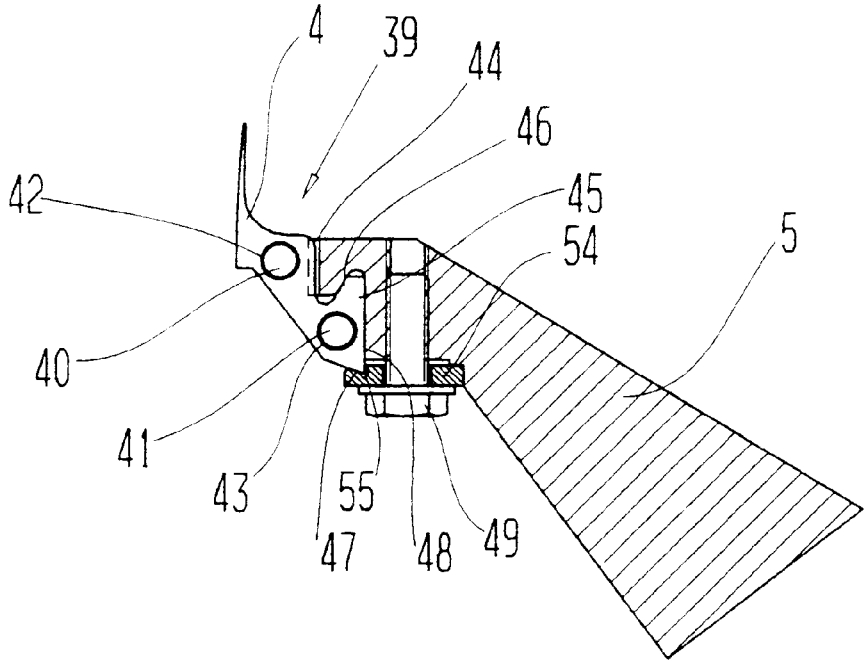
FIG. 8 is a fifth embodiment of a segment with slider plates.

FIG. 8 shows a slider bar 5 with slider plates 4 that form a segment 39. Here again, holes 40 and 41 are provided, into which hollow pins 42 and 43 are inserted and subsequently widened. Grooves 44 are provided in the bar for the receipt of sections of plates 4. At the rear end of each plate, a foot 45 is provided, which under the force of screw 49 is pressed against an angled surface 46 of the bar 5 and thus by means of a locking surface 48 of the plate, the appropriate parts of the plate 4 press against the base of the grooves 44 in bar 5 and the parts of plate 4 taken up by grooves 44 are pressed against the groove base. The angled surface 46 of bar 5 and the bar surface opposite the locking surface 48 of the plates 4 form a wedge-shaped opening into which the plates 4 are pulled by means of screw 49. Thus, the plates 4 are brought into the proper position in bar 5. Between the head of screw 49 and the bar 5 there is provided a small plate 54 which extends across the length of the segment. The plate 54 comprises a recess 55 which has an angled base with which the locking surface 47 of the plates 4 interacts. The plate 4 is additionally pressed against the bar by means of this locking surface 47.

Figure 9:
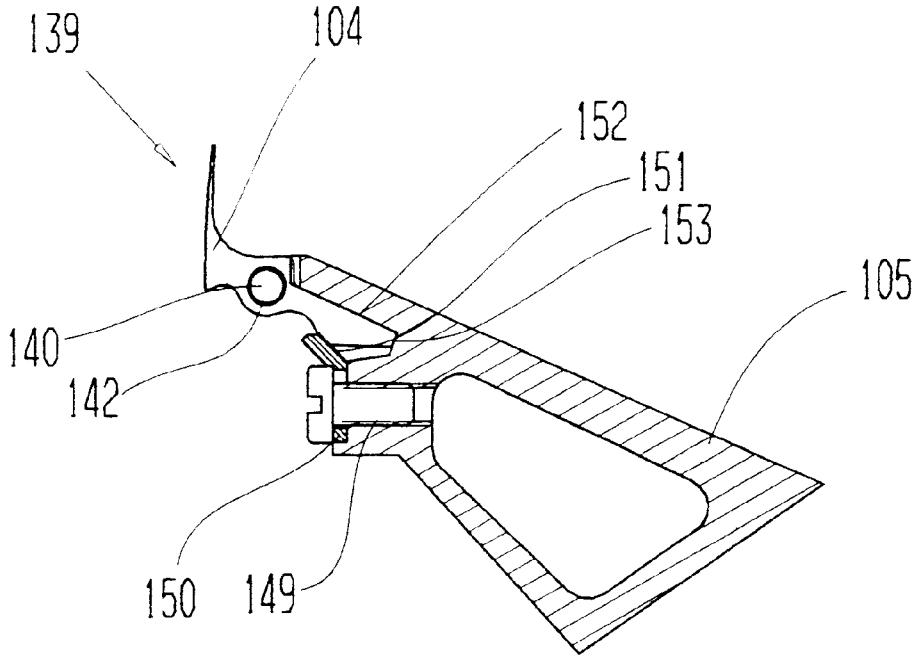
FIG. 9 is a sixth embodiment of a segment with slider plates.

In the embodiment of FIG. 9 the appropriate part numbers are raised by 100 relative to the corresponding parts in FIG. 8. The affixing screw 149 acts upon an intermediate piece 150 by an angled surface 151 running at an angle to the axis of the affixing screw 149. This screw 149 presses the plates 104 with its locking surfaces 152 and 153 against the corresponding mating surfaces of bar 105 so that the plates 104 have a defined, seated position. The use of a single pin 142 which is formed as a tube and led through hole 140 is adequate.

Obviously, many modifications and variations of the present invention are possible in light of the above teachings. It is therefore to be understood that within the scope of the appended claims, the invention may be practiced otherwise than as specifically described.

I claim:

1. A segment carrying knitting machine elements for attaching them to a bar in a warp knitting machine, comprising:

a spaced plurality of plates separated by a predetermined distance, and each having a hole;

a connecting arrangement having at least one hollow pin mounted through the holes in the plates, said pin having a circumference bearing upon the plates; arid an attachment arrangement for attaching said plates to said bar.

2. The segment in accordance with claim 1 wherein said at least one pin is made of the same material as the plates.

3. The segment in accordance with claim 1 wherein said at least one pin comprises light metal.

4. The segment in accordance with claim 3 wherein said at least one pin has a lower wall thickness than the plates.

5. The segment in accordance with claim 1 wherein said at least one pin is widened in order to connect to the plates.

6. The segment in accordance with claim 1 wherein said at least one pin comprises at least two hollow pins.

7. The segment in accordance with claim 1 wherein said at least one pin comprises at least three hollow pins.

8. The segment in accordance with claim 1 wherein the plates are glued together with said at least one pin.

9. The segment in accordance with claim 1 wherein said bar has a plurality of mating surfaces, the plates comprising a plurality of locking surfaces for engaging at least one of said mating surfaces in order to provide and define a seated position for the plates.

10. The segment in accordance with claim 1 wherein some neighboring ones of the plurality of plates have inside ends truncated to provide adjacent thereto a clear region for screw passage.

11. The segment in accordance with claim 1 wherein the attaching arrangement comprises:

an intermediate piece having in a groove area: (a) grooves for receiving rear portions of the plates, and (b) a recess shaped to allow said pin to snap into said recess, said intermediate piece being adapted to be pressed by an attaching screw against the bar to provide a form locking connection of the plates to the bar.

12. The segment in accordance with claim 1 wherein the attaching arrangement comprises:

an intermediate piece glued onto the rear ends of the plates, said intermediate piece having an attachment portion adapted to be secured to the bar.

13. The segment in accordance with claim 1 wherein the attaching arrangement comprises:

an intermediate piece adapted to receive an attaching screw along a predetermined axis, said intermediate piece having a surface running at an angle to the predetermined axis in order to bring the plates into a defined, seated position.

14. The segment in accordance with claim 1 wherein the ends of the plates comprise:

a support element running parallel to the pin, said support element being adapted to engage an attaching screw in order to bring the plates into a defined, seated position.

* * * * *